United States Patent [19]

Denis

[11] Patent Number: 4,616,689

[45] Date of Patent: Oct. 14, 1986

[54] FOUNDRY MOULDING PROCESS AND MOULD USING A PATTERN OF GASIFIABLE MATERIAL SURROUNDED BY SAND FREE OF A BINDING AGENT FOR LOW PRESSURE PRECISION CASTING

[75] Inventor: Jean-Pierre Denis, Nancy, France

[73] Assignee: Pont-A-Mousson S.A., Nancy, France

[21] Appl. No.: 700,839

[22] Filed: Feb. 12, 1985

[30] Foreign Application Priority Data

Feb. 15, 1984 [FR] France ..... 84 02907

[51] Int. Cl.[4] ..... B22C 9/04; B22D 18/04

[52] U.S. Cl. ..... 164/34; 164/137; 164/341; 164/306; 164/119

[58] Field of Search ..... 164/34–36, 164/137, 339, 341, 7.1, 7.2, 246, 306, 309, 160.1, 160.2, 119

[56] References Cited

FOREIGN PATENT DOCUMENTS 2163455 7/1973 France ..... 164/34

2455491 11/1980 France ..... 164/34

*Primary Examiner*—Kuang Y. Lin

*Attorney, Agent, or Firm*—Sughrue, Mion, Zinn, Macpeak & Seas

[57] ABSTRACT

A foundry mould for low pressure moulding of metal parts is constructed of a mould chamber (14) with a bottom surface (17) having an opening (31) through which molten casting metal can ascend. A peripheral pressure chamber (15) surrounds the side walls of the chamber (14) and a suction bell (18, 19) connected to a suction duct (23) covers the top of the mould chamber and pressure chamber. Communicating apertures (20, 21) provide gas flow paths from the mould chamber and pressure chamber to the suction bell. Patterns of gasifiable expanded polystyrene are located in the mould chamber and are supported therein by a masking device, such as a masking shell (28), by means of pattern appendages (26) connected to tubular supporting members (27) of the masking shell. A sleeve (34) is locked to the opening (31) and supports the masking device. Compacted, binderless, sand fills the remaining volume of the mould chamber. Moulded metal parts are produced according to the moulding process of the invention by forcing molten metal under low pressure upwardly through the sleeve, and the masking device to the pattern of gasifiable material, the heat of the molten metal gasifying the pattern material, the molten metal filling the voids left by the gasified patterns.

17 Claims, 6 Drawing Figures

FOUNDRY MOULDING PROCESS AND MOULD USING A PATTERN OF GASIFIABLE MATERIAL SURROUNDED BY SAND FREE OF A BINDING AGENT FOR LOW PRESSURE PRECISION CASTING

BACKGROUND OF THE INVENTION

The invention relates to the moulding of metal parts using a low pressure moulding process and the mould structure per se.

U.S. Pat. No. 2,830,343 discloses a precision moulding process which uses a pattern formed of disposable expanded polystyrene. The expanded polystyrene pattern is surrounded by sand, with or without a binding agent. In the process disclosed in U.S. Pat. No. 2,830,343 the mould is gravity fed with a liquid metal.

In French Patent No. FR-A-2 163 455 and its corresponding U.S. Pat. No. 3,861,447, there is disclosed a precision moulding process which uses a pattern made of gasifiable expanded polystyrene. A sand mould free of a binding agent surrounds the pattern of gasifiable polystyrene. The sand is compacted around the pattern by subjecting the sand mould to a negative or subatmospheric pressure. In that pressure, like the aforementioned process described in U.S. Pat. No. 2,830,343, the mould is gravity fed. The pattern of gasifiable material, which because of its brittle nature is coated with a thermohardenable resin shell, is neither exactly positioned nor rigidly fashioned within the mould chamber. According to the teachings of this French Patent liquid metal is gravity fed into the mould chamber at a constant flow rate which is neither so high as to release polystyrene gas into the moulded part or so low as to cause a premature and uncontrolled evaporation of the polystyrene. To accomplish this constant feed, there is required a pouring basin or feed cone to control the required constant flow of the liquid metal. The result is a process which displays a low yield, the yield being defined as the ratio of the mass of useful metal to the overall metal mass used. A low yield is realized, for a significant portion of the overall metal mass ends up as solidified metal inside the pouring basin and non-useful appendages to the cast part. The useful metal is that metal which forms the cast part itself.

In French Patent No. FR-A-2 455 491 and its corresponding Canadian Patent No. 1,166,818, there is disclosed a foundry mould comprises of a shell and a core. According to this French Patent, the foundry mould is centered and immobilized in the middle of a mass of metal particles free of a binding agent and rigidified by a magnetic field. Molten metal is fed into the mould from the bottom up under low pressure.

The process of French Patent No. FR-A-2 455 491 is advantageous for in using low pressure, it is possible to monitor the flow of molten metal throughout the period of time it takes to fill the mould cavity. Additionally, the low pressure process substantially improves metal yield for the casting ducts are very short and surplus molten metal, which exists after a part is moulded and solidified, can be easily recovered in a ladel by introducing a sudden drop in pressure on the molten metal. Because the molten metal is pressure fed upwardly into the casting cavity, metal yield is maximized for excess metal remains fluid outside the moulding cavity and falls back into the ladle in response to the pressure drop. This process is also advantageous for it permits the controlled evacuation of gases and because it can be combined with a process for the controlled suctioning of gases to thereby prevent gas inclusion in the moulded part.

Thus, as exemplified by the aforementioned U.S. Pat. No. 2,830,343 and French Patent No. FR-A-2 163 455, it is known to use patterns of gasifiable material such as expanded polystyrene in a gravity fed mould. Such patterns can be used to produce accurately moulded parts for they can be made hollow and thin and shaped exactly as the desired part is to be shaped. However, because of their brittleness, patterns of gasifiable material have not been usable in foundrys which operate with the low pressure moulding process.

SUMMARY OF THE INVENTION

It is an object of the invention to define a low pressure moulding process using patterns of gasifiable material.

It is a further object of the invention to define a low pressure moulding process using patterns of gasifiable material surrounded by sand free of a binding agent.

It is a still further object of the invention to develop a low pressure moulding process using patterns of gasifiable material surrounded by sand free of a binding agent in which the risk of gas inclusion in the moulded part is eliminated and the risk of sand entering the ascending casting duct while the sand enters the moulding chamber and during low pressure casting is also eliminated.

These and other objects of the invention, as will become apparent from the following detailed description of the preferred embodiments of the invention, are realized by a low pressure moulding process which provides a masking device which can be a mould masking shell, the lower part of which defines the mould casting mouth, the upper ends of which are connected to at least one pattern of gasifiable expanded polystyrene. The masking shell is connected at the lower part of the mould for receiving the ascending molten metal under low pressure. Sand free of a binding agent enters the top of the mould chamber as the chamber is vibrated to thereby uniformly surround the pattern of gasifiable material. Rigidity is supplied to the mould by a pressure reduction.

The mould produced according to the teachings of the invention may include two patterns of gasifiable expanded polystyrene surrounded by a mass of sand free of a binding agent. The pressure reduction for rigidifying the mould is realized by providing the mould with a peripheral pressure chamber, and sealing and suction means. The patterns are positioned interior of the mould chamber by means of a centering and locking sleeve to which the masking shell is connected. The centering and locking sleeve has a lower section with a locking means for locking the lower section of the sleeve to the moulding chamber or flask. This lower section corresponds to the mould casting opening. The sleeve is made of a hardened mixture of sand and a binding agent. The patterns are provided with appendages for connecting the patterns to the upper portion of the masking shell. Where necessary, supports can be located in the mould chamber to support the ends of the patterns opposite to the ends carrying the appendages connected to the masking shell.

DETAILED DESCRIPTION OF THE PREFERRED EMBODIMENTS

Figure 5:
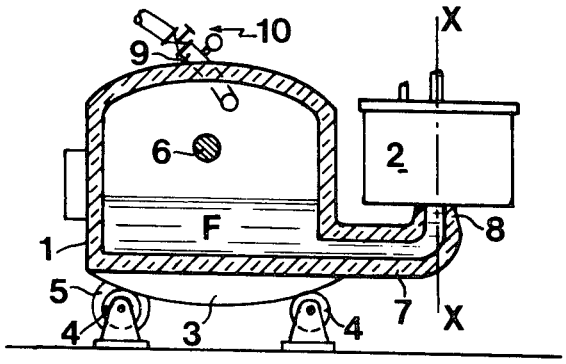
FIG. 5 illustrates foundry facility for the feeding of molten metal under low pressure according to the teachings of the present invention.

Referring first to FIG. 5, there is shown therein a low pressure casting facility using a foundry mould according to the invention. The casting facility includes a smelting furnace 1 which may be replaced by a low pressure foundry ladel. Also included is a foundry mould 2. The smelting furnace 1 may be of the electric type tiltable on cradle 3 which in turn is carried on rollers 4. One of the rollers is a driven roller, driven by gears 5 connected to a suitable drive source (not shown). The electric furnace 1 may be heated by radiation from a horizontal graphite rod 6. The furnace dome reverberates heat radiated onto the metal bath F. The casting tube 7 may have a tubular cross-section and communicate with the interior of the furnace 1 at the lower portion of the furnace as illustrated. The casting tube 7 is provided at its open end with a casting nozzle 8 which is preferably truncated. This nozzle is designed to connect in a sealed fashion with a casting mouth or opening forming a part of the mould 2.

A duct 9 leads into the upper part of the furnace 1 and is used to convey inert gas under pressure above the metal bath F. The metal bath may be molten pig iron, ferrous, or non-ferrous metal, an alloy, or any of various other types of metals used in making cast metal parts. The inert gas is preferably argon. However, nitrogen or pressurized air can also be used.

A pressure intake and adjustment fitting 10 with a valve and measuring dial for measuring the pressure inside the furnace above the metal bath is mounted to the duct 9. Such an arrangement is described in French Patent Application No. 82 17 120 filed Oct. 11, 1982.

Figures 1, 2:
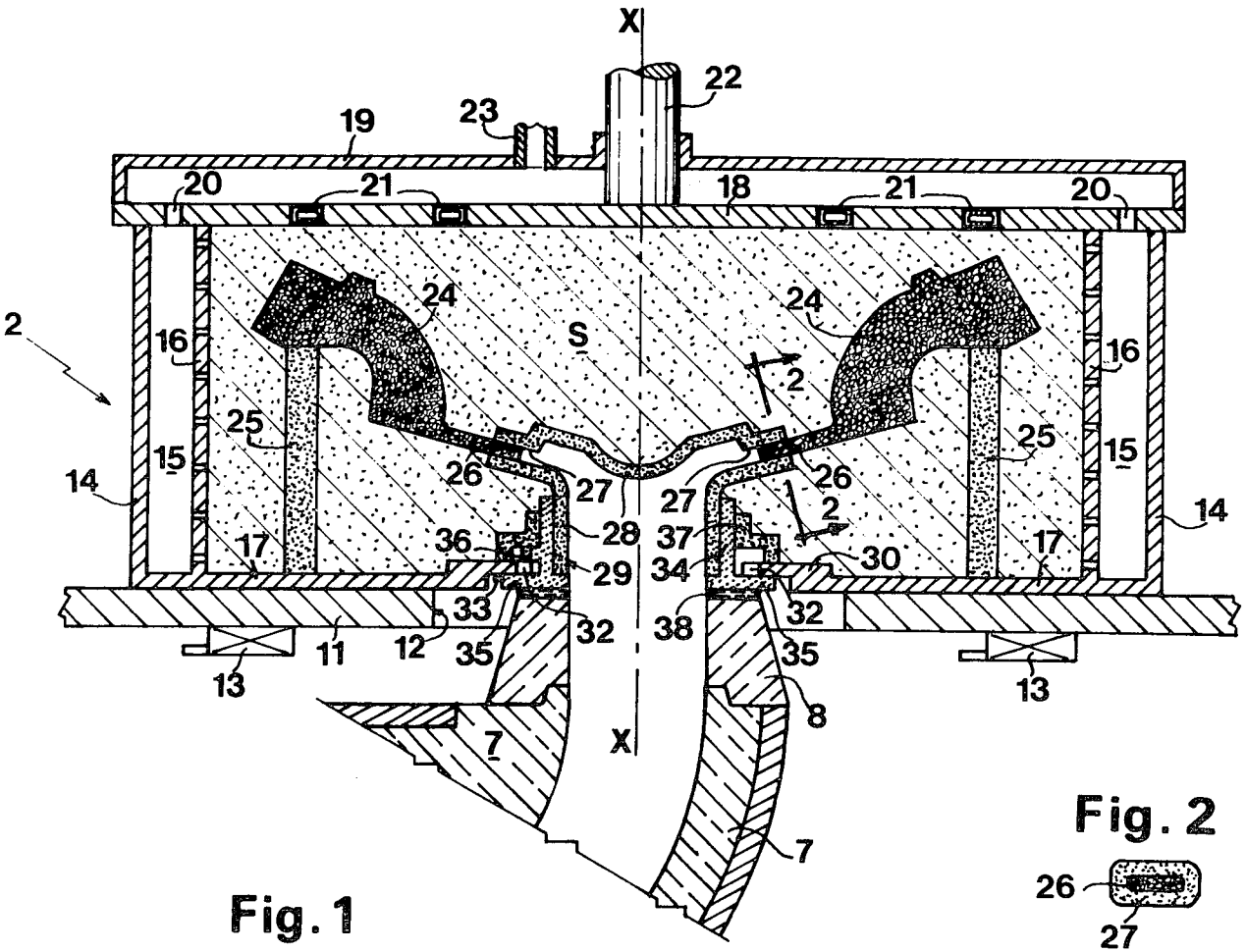
FIG. 1 is a schematic illustration of a foundry mould according to the teachings of the present invention.
FIG. 2 illustrates a section of the foundry mould illustrated in FIG. 1 taken across line II—II.
Figure 3:
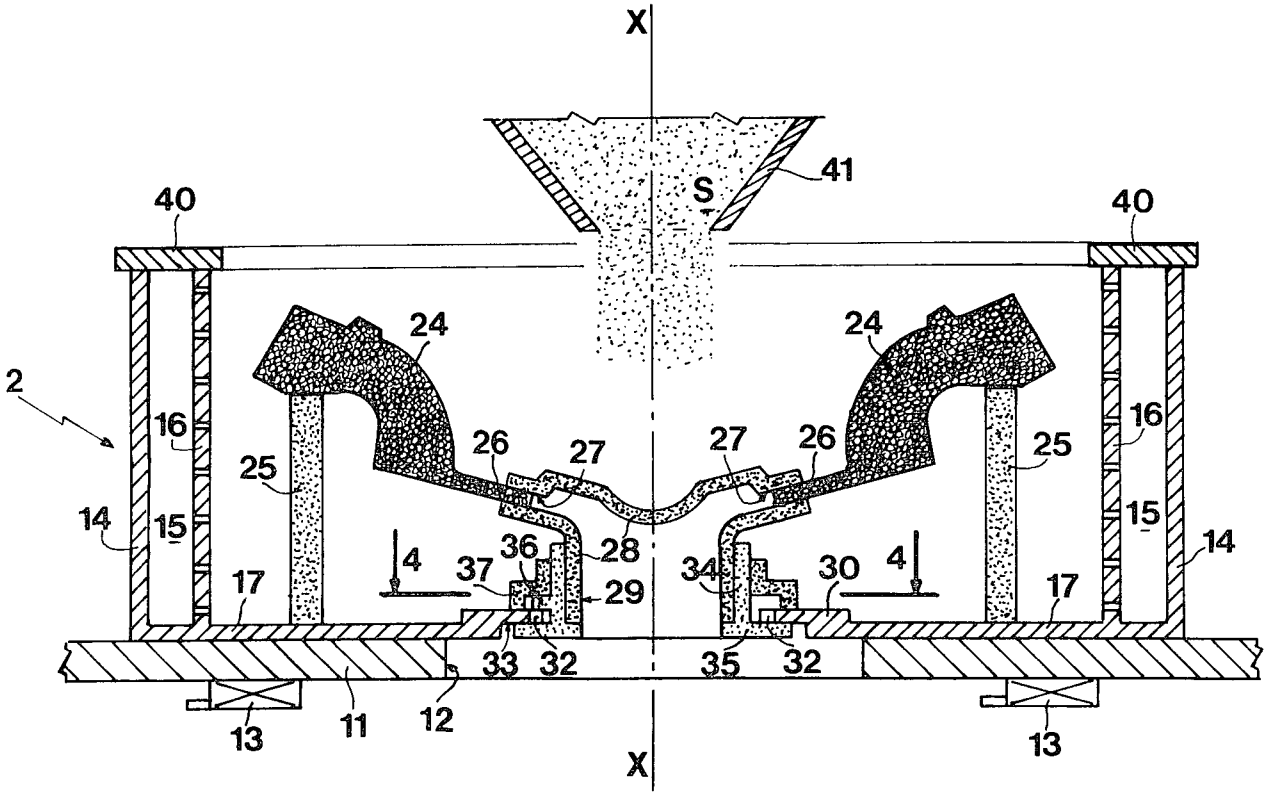
FIG. 3 is a schematic illustration of the foundry mould of FIG. 1 at a point during the formation of the mould and specifically at that point when dry sand without binding agent is added to the mould chamber.

Referring now to FIGS. 1, 2 and 3, the foundry mould 2 is placed on a table 11, which table can form part of a mould conveyor. The table 11 includes a wide opening 12 for receiving the truncated nozzle 8 of the casting tube 7 in the casting mouth of the mould 2. Vibrating devices 13 are fastened to the table 11 on both sides of the mouth 12.

The mould 2 includes a conventional mould flask or chamber 14 as well as a suction mechanism of the type described in French Patent No. FR-A-2 163 455. The mould chamber 14 is provided with a peripheral vacuum or suction chamber 15 bordered by peripheral, perforated, inner partitions 16 defining the side walls of the mould chamber 14. The perforations and the partitions 16 are sized to prevent the passage of dry sand S from the interior of the chamber 14 to the chamber 15.

The chamber 14, preferably constructed of metal, also includes a bottom 17. A pressure head 18 over which is positioned a suction bell 19, covers the chamber 14. The pressure head 18 includes openings 20 that lead into the peripheral chamber 15 and filtered openings 21 which allow air and gases to pass therethrough while preventing the passage of sand S. Openings 20 can be replaced with filtered openings 21 if desired. A jack stem 22 for applying pressure to the pressure head 18 is located above and in contact with the pressure head along the XX axis. The pressure applied by the jack stem 22 causes the contents of the flask 14 to be compacted and the entire mould 2 to be pressed against the table 11. The suction bell 19 is connected to a suction duct 23.

Patterns 24 of gasifiable expanded polystyrene (two being illustrated in this example) are trapped within the sand masks S compacted in the chamber 14 between the partitions 16, bottom 17 and pressure head 18. The patterns 24 may be coated with a synthetic resin. They are depicted here as a solid mask but may be hollow if they are designed to provide hollow parts such as exhaust pipes for automobile engines.

The patterns 24 are positioned and supported in the sand S in the following manner. Supports 25 are provided to support the outer ends of the patterns. The supports 25 may be made of a hardened mixture of sand and resin. The end of each pattern closest to the XX axis includes an appendage 26 shaped to mate with openings 27 of a masking shell 28. Masking shell 28 is located to be symmetric about the XX axis. This shell 28 is made of a hardened mixture of sand and thermo-hardenable resin. If desire, the shell may also be made of a hardened mixture of sand and a mineral binding agent. It is termed a masking shell for it acts as a hat or cover for the casting mouth 29 of the mould 2. The casting mouth 29 is connected at the casting opening with the truncated nozzle 8. The masking shell also acts as the connecting conduit for connecting the casting mouth 29 with the appendages 26 of the patterns 24. Thus, the shell 28 includes a tubular section 29 functioning as the casting mouth of the mould 2 extending into a Y-shaped section having fitting openings 27 for mating with the appendages 26. As illustrated in FIG. 2, when the appendages 26 have a rectangular cross-section, the fitting openings 27 have a hollow rectangular cross-section for receiving these appendages. For the reasons hereinafter explained, the appendages 26 and the openings 27 slop downwardly toward the XX axis forming a centrally located concave top portion.

Figure 4:
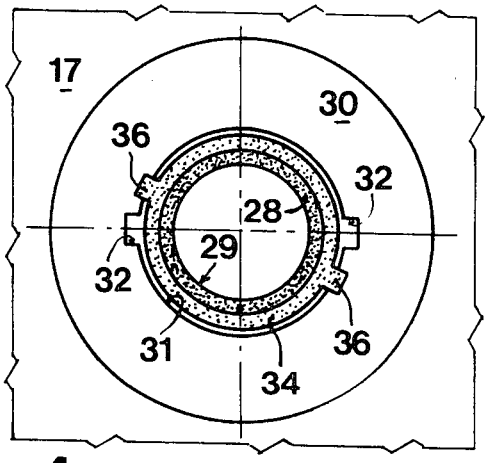
FIG. 4 illustrates a section of the mould illustrated in FIG. 3 taken across line IV—IV.

A centering and locking sleeve 34 is mounted in the foundry chamber 14 in the following manner. The bottom 17 of the chamber 14 includes a boss 30 symmetrical about the XX axis. As shown in FIGS. 1 and 4, a circular opening 31 lies interior to the boss 30. The opening 31 may include a pair of rectangular cutouts 32 positioned diametrically from each other. The underside of the boss 30 may be provided with a circular recess having a diameter somewhat greater than the diameter of the opening 31. As can be seen from FIG. 1, the diameter of the opening 31 exceeds the diameter of the casting mouth 29.

In accordance with the teachings of the invention, the sleeve 34, preferably of ceramic material, is locked onto the boss 30 in the following way. This sleeve has an inner diameter which corresponds to the outer diameter of the casting mouth 29 to thereby accommodate the mouth 29 as illustrated in FIG. 1. More specifically, the sleeve 34 includes a lower flange 35 producing an inner directed circular protrusion which supports the lower end of the casting mouth 39 of the masking sleeve 28. The flange 35 is designed to be lodged in the recess 33 of the boss 30. The centering sleeve 34 is provided with a pair of rectangular locking lugs 36 separated from the lower flange 35 of the sleeve 34 a distance corresponding to the thickness of the boss 30 in the region of its recess 33. The lugs 36 are sized to be slightly smaller than the cut-outs 32 allowing them to pass through these cut-outs. The sleeve 34 passes through the hole 31 with the lugs 36 passing through the cut-outs 32 and is then rotated whereby the lugs 36 lock the sleeve 34 to the boss 30.

A plate 37 as illustrated in FIG. 1 covers the upper side of the boss 30, the cut-outs 32, lugs 36 and part of the sleeve 34.

Manufacturing the mould illustrated in FIGS. 1–4 occurs as follows. The chamber 14 is placed on the plate 11. Pattern supports 25 are then placed on the bottom 17 of the chamber 14. The chamber is uncovered to the air by removing the plate 18. The centering and locking sleeve 34 is then inserted into the circular opening 31 such that the lower flange 35 rests against the underside of the boss 30 in the vicinity of its recess 33. To accomplish this insertion, the lugs 36 are caused to coincide with the cut-outs 34 as the sleeve proceeds through the opening 31. After the lower flange 35 has been seated, the sleeve 34 is rotated about the XX axis so that the lugs 36 rest on the upper side of the boss 30. In this manner, the sleeve 34 locks to the boss 30 of the chamber bottom 17. The plate cover 37 is then inserted through the top of the chamber to surround the sleeve 34 and cover a portion of the upper side of the boss 30 in the area of the lugs 36 and cut-outs 32. The sleeve 34 is now ready to receive and support the foundry masking shell 28 which is inserted through the top of the chamber 14 and rests on the inner crown of the flange 35.

Each pattern of gasifiable material, such as expanded polystyrene, is inserted from the top and positioned such that its gate appendage 26 mates with a fitting portion 27 of the masking shell. The portion of each pattern opposite the appendage rests on the support 25. In this manner, each pattern is centered, balanced and fixed within the mould chamber.

Before binderless sand fills the chamber 14, the peripheral suction chamber 15 is sealed with a temporary upper plate 40. Plate 40 functions to prevent sand from entering the chamber 15. The binderless dry sand enters the chamber 14 via a sieve 41 preferably located along the XX axis. If desired, the sieve 41 may be reciprocated above the sand receiving chamber to more evenly distribute the sand in the mould. Caution should be used to avoid to the extent possible possible the direct application of sand to the horizontal or slightly tilted surfaces of the pattern. During the sand filling operation (FIG. 3) the vibrators 13 are activated to assist in the even distribution of sand inside the chamber 14. Preferably, the patterns 24 are positioned to tilt downwardly toward the XX axis. Such a positioning assists the movement of sand to the bottom of the chamber below the pattern.

When the patterns 24 and their supports 25 are completely surrounded with sand and when the chamber is covered with sand to the height of the plate 40, the plate is removed and replaced by the suction bell 19 with its plate 18. Pressure is applied to the mould chamber through the jack stem 22 and upper plate 18. Suction is applied through the duct 23 to the suction bell 19 to thereby apply a negative pressure to the sand within the chamber 14. This suction functions to maintain rigidity of the sand mass S and to evacuate the gases during the casting process as the molten metal rises in the casting mouth 29. Under low pressure, the molten metal rises past the mouth 29 through the masking shell 28 and openings 27 to impinge first upon the gate appendages 26 and then the patterns themselves. As the expanded polystyrene forming the patterns and the appendages receive the heat of the molten metal, it gasifies leaving a cavity for the molten metal to fill.

The flow of molten metal such as pig iron or steel in the mould cavities formed by the gasification of the expanded polystyrene is controlled by monitoring the pressure inside duct 9. An example of a procedure for monitoring the pressure in duct 9 is contained in French Patent Application No. 82 17 120. It is important to control the flow for if it is too slow the polystyrene may be roasted before gasification, while if too fast there would not be enough time to allow the gases to escape cape with the result that significant quantities of gas remain trapped in the cast metal.

By combining the foundry masking shell 28 which defines the shape of the casting mouth 29 with patterns of gasifiable material, patterns of gasifiable material can be used in low pressure foundry moulds using binderless sand, for the masking shell accepts the shock of the sand drop thereby protecting the pattern against sand erosion. Additionally, the masking shell formed of sturdy material receives the first shock of molten metal. This molten metal is thereafter distributed in a laminar flow under low pressure to the patterns. The masking shell 28 also prevents a direct contact between the initial spray of molten metal and the sand mass. Should such a direct contact take place, sand would erode and fill the nozzle 8 preventing proper flow of molten metal into the casting cavities.

As the masking shell 28 is centered and stablized by the sleeve 34, these patterns are accurately positioned and immobilized during the sand filling operation and during the casting operation.

Using a low pressure feed in combination with a suction produced by the suction bell 19 produces a mould which accepts molten metal at an optimum flow rate. Additionally, the arrangement permits the use of binderless sand making it possible to rapidly evacuate the produced gases, remove the molded parts from the sand with ease, and allows for the reuse of the sand.

The moulding process and mould produced in accordance with the invention significantly improves the molten metal yield defined as the ratio of the weight of the cast part to the overall weight of the cast part and its appendages. The yield achieved using the mould of the invention exceeds 70% as compared to the usual yield of 30%. Not only is an improved yield realized, but also very thin cast parts, as thin as 2.5 millimeters, can be directly cast.

Figure 6:
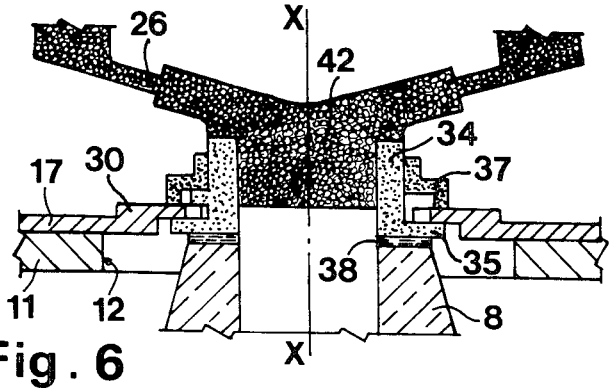
FIG. 6 is a second embodiment of the mould of the present invention.

A second embodiment of the invention is illustrated in Figure 6. In this embodiment, the masking shell 28 is eliminated and replaced by an expanded polystyrene shaft 42. This shaft has a shape similar to the shape of the masking shell 28. More specifically, it includes an upper concave section which extends upwardly to form a generally Y-shape with its lower portion forming the leg of the Y. The arms of the Y are formed integral with the appendages 26. The leg of the Y-shaped shaft 42 is shaped with a shoulder which can fit and rest on the centering and locking sleeve 34. The sleeve 34 now functions directly as the mould mouth. The variation illustrated in FIG. 6 is less expensive to produce than the embodiment of the invention illustrated in FIG. 1. However, the FIG. 6 arrangement does produce an additional quantity of gas as the heat of the molten metal reaches the shaft 42 gasifying that shaft. Thus, the arrangement of FIG. 6 is suitable for moulding relatively large parts where the inclusion of gas in the cast parts does not deteriorate the quality of those parts.

It is to be understood that the moulds hereinbefore described are exemplary embodiments of the invention and that various modifications may be included without departing from the spirit and scope of the invention. For example, the bayonet locking system which includes the cut-outs 32 and lugs 36 can be eliminated and the sleeve 34 attached to the bottom 17 using any of several known attaching arrangements. For example, the sleeve 34 can be glued to the bass 30.

The invention is, of course, not limited to two patterns and one or several patterns can be supported in the mould chamber 14. Furthermore, the melting furnace 1 can be replaced with a low pressure pouring ladel with a vertically rising refractory feed pipe. The vertical refractory pipe is connected in a sealed fashion to the casting mouth 29 of the mould, its upper end being connected via a sealing washer 38 to the flange 35. The lower end of the vertical refractory pipe is submerged in the molten metal contained in the ladel.

With the method of moulding and the mould disclosed hereinabove, metals such as pig iron, oxidating metal alloys such as steel, as well as super alloys and alloys with less than 20% iron and significant percentages of nikel, chromium or cobalt can be efficiently used to cast precision metal parts.

What is claimed is:

1. A foundry mould for the low pressure casting of metal parts comprising:

a mould chamber (14) including a bottom surface (17) with an opening (31) through which molten metal can ascend, and side walls (16);

a peripheral pressure chamber (15) surrounding said side walls, said side walls having apertures for communicating the interior of said mould chamber with said peripheral pressure chamber;

a sealing and suction means (18, 19) covering the top of said mould chamber and said peripheral pressure chamber, and containing suction apertures for communicating said sealing and suction means with said mould chamber and said peripheral pressure chamber;

at least one pattern (24) of gasifiable material positioned within said mould chamber;

masking means (27, 42) positioned in the vicinity of said opening (31) and being connected to said at least one pattern for supporting said at least one pattern in a position to receive said ascending molten metal;

binderless sand (5) surrounding said at least one pattern, and overlying said masking means, said masking means preventing sand from entering said opening; and centering and locking sleeve means (34) located at least partially within said opening (31) for supporting said masking means, the lowermost portion of said sleeve defining the position of the mould casting mouth.

2. The foundry mould as claimed in claim 1, wherein said at least one pattern of gasifiable material includes an appendage for connecting the pattern to the masking means.

3. The foundry mould as claimed in claim 1, wherein said gasifiable material is expanded polystyrene.

4. The foundry mould as claimed in claim 2, wherein said sleeve (34) includes a flange (35) with an inwardly extending shoulder for supporting said masking means, and lugs (36); said bottom surface (17) having a boss (30) surrounding said opening (31), said boss having a recess portion (33) along its underside, and cut-outs (32) sized to pass said lugs (36), whereby said sleeve is retained in said opening by passing it through the opening, the lugs passing through the cut-outs until the flange (35) contacts the underside of the recess (33) and thereafter rotating the sleeve so that the lugs overlie the upper surface of the boss.

5. The foundry mould as claimed in claim 2, wherein said masking means comprises a hollow masking shell having a tubular leg supported by said sleeve (34), the lower portion of said tubular leg forming the mould casting mouth, and at least one open ended tubular supporting member (27) for receiving and maintaining therein the appendage of said at least one pattern.

6. The foundry mould as claimed in claim 5, wherein said masking shell is comprised of a hardened mixture of sand and resin.

7. The foundry mould as claimed in claim 6, further including a plurality of patterns each of gasifiable material, said masking shell including a plurality of open ended tubular supporting members (27) each receiving and maintaining therein a pattern appendage.

8. The foundry mould as claimed in claim 7, wherein said masking shell has a centrally located concave top portion, said tubular supporting members extending outwardly and upwardly from said concave top portion, said patterns extending in an upwardly sloping direction from the open ends of the tubular supporting members.

9. The foundry as claimed in claim 8, further including support bars (25) for further supporting the patterns.

10. The foundry mould as claimed in claim 9, further including a cover plate (37) covering the lugs (36), the cutouts (32) and a portion of said boss (30).

11. The foundry mould as claimed in claim 10, further including vibrating means (13) for vibrating the mould as binderless sand enters the mould chamber (14), pressure producing means (22) for compacting the received sand in the mould chamber and around the patterns, and suction application means (23) connected to said sealing and suction means (18, 19) for evacuating gases in said mould chamber.

12. The foundry mould as claimed in claim 11, further including means coupled to said mould casting mouth of said masking shell for introducing molten metal into the casting mouth.

13. The foundry mould as claimed in claim 2, wherein said masking means comprises a shaft portion (42) of gasifiable material having a lower section extending into the interior of said sleeve (34), and an upper section with at least one upwardly and outwardly extending member connected to the appendage of said at least one pattern.

14. The foundry mould as claimed in claim 13, further including a plurality of patterns each of gasifiable material, the upper section of said shaft portion (42) having a plurality of upwardly and outwardly extending members, each connected to a pattern appendage, the central, topmost portion of said upper section being concave.

15. A method for low pressure foundry casting metal parts using a foundry mould chamber (14) having a bottom surface (17) with an opening (31) through which molten metal to be cast can ascend comprising the steps of:

positioning a pattern of gasifiable material in the mould chamber;

providing said pattern with an appendage;

mounting a masking device to said opening (31), and attaching said pattern appendage to a portion of the masking device to thereby support the pattern and locate the pattern a desired location relative to said opening;

filling the remaining volume of said mould chamber with binderless sand, the masking device preventing sand from entering said opening;

vibrating and pressure packing said sand to produce a rigid sand mass surrounding said pattern; and applying ascending molten metal through said opening and said masking device to said pattern, the heat of the molten metal gasifying the pattern material allowing the molten material to replace the pattern material, thereby forming metal parts in the shape of the pattern as the molten metal cools.

16. The method for low pressure foundry moulding metal parts as claimed in claim 15, further including the step of: applying and locking a sleeve within the opening, and mounting said masking device on said sleeve.

17. The method for low pressure foundry moulding metal parts as claimed in claim 16, further including the step of: evacuating the gases in the mould chamber as the pattern material gasifies.

* * * * *